US010878785B2

(12) United States Patent
Baker

(10) Patent No.: US 10,878,785 B2
(45) Date of Patent: Dec. 29, 2020

(54) STRINGED INSTRUMENT PICK HOLDER WITH ADAPTATION TO PICK GUARD

(71) Applicant: Donald L Baker, Tulsa, OK (US)

(72) Inventor: Donald L Baker, Tulsa, OK (US)

( * ) Notice: Subject to any disclaimer, the term of this patent is extended or adjusted under 35 U.S.C. 154(b) by 0 days.

(21) Appl. No.: 16/845,482

(22) Filed: Apr. 10, 2020

(65) Prior Publication Data

US 2020/0365122 A1 Nov. 19, 2020

Related U.S. Application Data

(60) Provisional application No. 62/847,449, filed on May 14, 2019.

(51) Int. Cl.
*G10D 3/173* (2020.01)

(52) U.S. Cl.
CPC ..... *G10D 3/173* (2020.02)

(58) Field of Classification Search
CPC ..... G10D 3/173
See application file for complete search history.

(56) References Cited

U.S. PATENT DOCUMENTS

| | | | | |
|---|---|---|---|---|
| 3,181,410 | A | 5/1965 | Phillips | |
| 3,442,169 | A | 5/1969 | Bowers | |
| 3,752,029 | A | 8/1973 | Watrous | |
| 4,135,431 | A * | 1/1979 | Ferguson | G10D 3/173 84/329 |
| 4,785,708 | A | 11/1988 | Vaughan | |
| 4,890,531 | A | 1/1990 | Tischer | |
| 4,982,641 | A | 1/1991 | Duhart | |
| 5,127,300 | A | 7/1992 | Silverman | |
| D355,667 | S | 2/1995 | Burger | |
| 5,413,020 | A | 5/1995 | Thompson | |
| D362,264 | S | 9/1995 | Trees | |
| 5,488,892 | A | 2/1996 | Jepsen | |
| 5,649,634 | A | 7/1997 | Irizarry | |
| 5,651,468 | A | 7/1997 | Irizarry | |
| 5,796,021 | A | 8/1998 | Longshore | |
| 5,837,913 | A | 11/1998 | Newman | |
| 5,905,217 | A | 5/1999 | Byers | |
| 6,054,643 | A | 4/2000 | Chance | |
| 6,262,354 | B1 | 7/2001 | Solomon | |
| 6,933,430 | B2 | 8/2005 | Oskorep | |
| 7,312,388 | B2 | 12/2007 | Oskorep | |
| 7,417,184 | B2 | 8/2008 | Weathersby | |
| 7,626,103 | B1 | 12/2009 | Phillips | |
| 7,847,171 | B1 | 12/2010 | Kidd | |
| 9,047,849 | B2 | 6/2015 | Koster | |
| 9,135,897 | B2 | 9/2015 | McDonald | |
| 9,418,663 | B2 | 8/2016 | Storck | |

(Continued)

FOREIGN PATENT DOCUMENTS

ES 1161410 U 10/2016

*Primary Examiner* — Robert W Horn

(57) ABSTRACT

This invention uses a simple, decorative and effective way to hold picks to a guitar body, especially a solid electric guitar body or the head of a neck. It comprises a flat plate, which can be conveniently included in the design of a pick guard, using at least one mounting screw, one or more fingers to hold down individual picks, each tensioned by separate screw, and a thin shield under the pick holder to keep each pick from rubbing on the body finish. The parts can be cut, carved or printed to decorative designs.

4 Claims, 3 Drawing Sheets

© 2019-2020 don baker dba android originals LC

(56) References Cited

U.S. PATENT DOCUMENTS

| | | | |
|---|---|---|---|
| 9,704,459 | B1 | 7/2017 | Paterson |
| 9,734,806 | B1 | 8/2017 | Storck |
| 9,837,056 | B1 | 12/2017 | Davis |
| 2010/0263515 | A1 | 10/2010 | Hollin |

* cited by examiner

© 2019 don baker dba android originals LC

© 2019-2020 don baker dba android originals LC

FIG. 3A
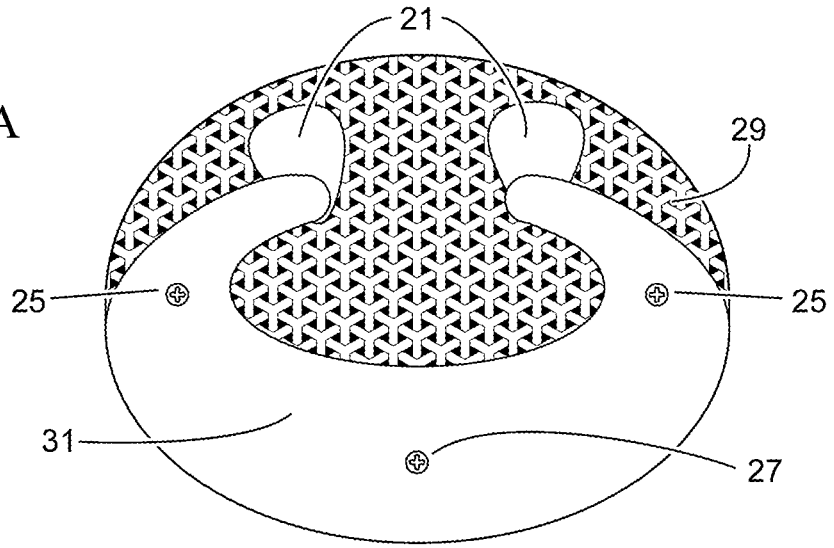
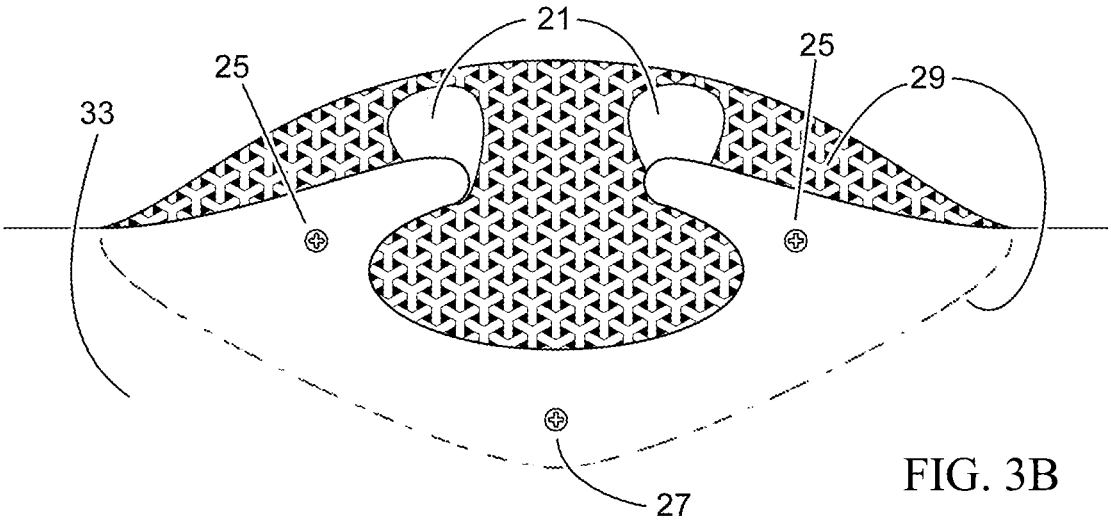
FIG. 3B
© 2019 don baker dba android originals LC

STRINGED INSTRUMENT PICK HOLDER WITH ADAPTATION TO PICK GUARD

This application claims the benefit of precedence of the U.S. Provisional Patent Application, 62/847,449, filed 2019 May 14 by this inventor, Donald L. Baker dba android originals LC, Tulsa Okla. USA

COPYRIGHT AUTHORIZATION

Other than for confidential and/or necessary use inside the Patent and Trademark Office, this authorization is denied until the Nonprovisional patent application is published (pending the request for delay of publication below), at which time it may be taken to state:

The entirety of this application, specification, claims, abstract, drawings, tables, formulae etc., is protected by copyright: © 2019-2020 Donald L. Baker dba android originals LLC. The (copyright or mask work) owner has no objection to the facsimile reproduction by anyone of the patent document or the patent disclosure, as it appears in the Patent and Trademark Office patent file or records, but otherwise reserves all (copyright or mask work) rights whatsoever.

APPLICATION PUBLICATION DELAY

Not Applicable—Although critical customer information will be redacted, this Customer intends to make full patent record available on ResearchGate.net. This patent application shall also be published as usual.

CROSS-REFERENCE TO RELATED APPLICATIONS

Not Applicable

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENTS REGARDING PRIOR DISCLOSURES BY THE INVENTOR OR A JOINT INVENTOR

Not Applicable

TECHNICAL FIELD

This invention describes a flat-spring type of pick holder for stringed instruments, which can be mounted on the instrument by itself, or be incorporated into the design of the pick guard of an electric guitar.

REFERENCES

ES1161410Y, Moreno & Lon, 2016-10-19, Holder support guitar picks or similar (attaches pick to special ring on finger)

U.S. Pat. No. 3,181,410, Phillips, 1965-05-04, Guitar pick retention (magnetic pick retention on guitar)

U.S. Pat. No. 3,442,169, Bowers, 1969-05-06, Guitar pick holder (pick with bolt-on ring for finger)

U.S. Pat. No. 3,752,029, Watrous, 1973-08-14, Pick holder (coil spring for holding several picks, with attachment device for instrument)

U.S. Pat. No. 4,135,431, Ferguson, 1979-01-23, Stringed musical instrument pick dispenser (dispenser for multiple picks, attached to pick guard)

U.S. Pat. No. 4,785,708, Vaughan, 1988-11-22, Pick holder for stringed instruments (wide, thin holster for multiple picks attachable to guitar body)

U.S. Pat. No. 4,890,531, Tischer, 1990-01-02, Musical instrument pick holder (coil spring for holding multiple picks, attached to musical instrument or other surface)

U.S. Pat. No. 4,982,641, Duhart, 1991-01-08, Guitar pick holder (pick attached by lanyard to wrist)

U.S. Pat. No. 5,127,300, Silverman, 1992-07-07, Pick holder for a stringed musical instrument (folded spring with slot for multiple picks and recess for holding allen wrench)

U.S. Pat. No. 5,413,020, Thompson, 1995-05-09, Retracting guitar pick holder (pick on elastic lanyard through hollow tube to wrist strap)

U.S. Pat. No. 5,488,892, Jepsen, 1996-02-06, Pick holder (flat, close-fitting compartment for single pick, stackable & attachable to guitar body)

U.S. Pat. No. 5,649,634, Irizarry, 1997-07-22, Holder for thin planar objects (coil spring attached to suction cup)

U.S. Pat. No. 5,651,468, Irizarry, 1997-07-29, Holder for thin planar objects (coil spring attached to spring clip)

U.S. Pat. No. 5,796,021, Longshore, 1998-18-18, Pick holder for guitars and other stringed instruments (slotted bar for holding single pick to guitar with legs & small feet)

U.S. Pat. No. 5,837,913, Newman, 1998-11-17, Plectrum holder and method for using same (pick held on elastic or spring-retrieved lanyard to finger ring)

U.S. Pat. No. 5,905,217, Byers, 1999-05-18, Pick holder (flexible snap holster for single pick, sewn onto guitar strap or hung from strap button)

U.S. Pat. No. 6,054,643, Chance & Gray, 2000-04-25, Guitar pick with gripping means (pick with spring clip)

U.S. Pat. No. 6,262,354, Solomon, 2001-07-17, Protective guard and pick holder for musical instruments (string cover with recesses for 2 picks)

U.S. Pat. No. 6,933,430, Oskorep, 2005-08-23, Guitar pick holder made of a flexible magnetic body (refrigerator magnet on guitar holds down picks with metallic parts)

U.S. Pat. No. 7,312,388, Oskorep, 2007-12-25, Guitar pick stickers which provide highly-platicized formulations or material to synthetic guitar picks (ditto)

U.S. Pat. No. 7,417,184, Weathersby, 2008-08-26, Portable guitar pick holder apparatus (pick holster that works like store shelf springs to dispense picks)

U.S. Pat. No. 7,626,103, Phillips, 2009-12-01, Musical instrument pick holder (flat, single-pick holster with internal spring retention and metal ring to attach to key ring)

U.S. Pat. No. 7,847,171, Kidd, 2010-12-07, Guitar with pick support (coil spring pick holder mounted on guitar)

U.S. Pat. No. 9,047,849, Koster, 2015-06-02, Pick holder (single-pick socket with suction cup)

U.S. Pat. No. 9,135,897, McDonald & Benjamin, 2015-09-15, Magnetic guitar pick ring and material for use therewith (finger ring attached to pick either magnetically or by lanyard chain)

U.S. Pat. No. 9,418,663, Storck, 2016-08-16, Pick holder for stringed musical instrument picks (array of p-shaped spring clips to hold picks)

U.S. Pat. No. 9,704,459, Paterson, 2017-07-11, Pick holder (complex money-clip type pick holder with spring clip for mounting the guitar strap & decoration)

U.S. Pat. No. 9,734,806, Storck, 2017-08-15, Guitar pick holder with integral strap holder (pick with several alternative slots and jaws for gripping guitar strap)

U.S. Pat. No. 9,837,056, Davis, 2017-12-05, Guitar pick holder (hand-held device with retention for several picks to pick strings simultaneously or in sequence)

US2010/0263515, Hollin, 2010-10-21, Plectrum with attached grasping devices (pick with slot or Velcro hooks for lanyards)

U.S. D355667, Burger, 1995-02-21, Guitar pick holder (spring wire with coils for holding picks)

U.S. D362264, Trees, 1995-09-12, Holder for guitar pick (pick lanyard and wrist strap with ornamental design)

Background and Prior Art—Technical Problems Found and Resolved

The references cover the prior art which this inventor was able to find after creating the invention. Most, if not all of them suffer from some deficiencies or inconveniences: 1) hanging the pick on or off the finger or wrist, which can be distracting; 2) complex design, more expensive to manufacture; 3) allowing the picks to stick up above the surface of the guitar, where they can get knocked off; and 4) placing the picks across the strings from the guitarist or on the neck, where they are less convenient to reach.

This inventor had been slipping picks under the low-E string side of an ordinary electric guitar pick guard, as shown in FIG. 1A. Then he designed a homemade pick guard, as shown in FIG. 1B, which keeps at least two picks handy to the guitarist between the guitarist and the strings. The next step was to deliberately design adjustable fingers into the pick guard to hold picks with friction and the pressure of the pick guard against the guitar body, as generated by the pick guard mount screws, as shown in FIGS. 2 & 3. This invention adds a tension screw per finger, specifically to allow for different thicknesses and materials of picks, and an optional shield of thin material to protect the guitar finish from the sliding of the picks.

SUMMARY OF INVENTION

This invention uses a simple, decorative and effective way to hold picks to a guitar body, especially a solid electric guitar body or the head of a neck. It comprises a flat plate, which can be conveniently included in the design of a pick guard, using at least one mounting screw, one or more fingers to hold down individual picks, each tensioned by separate screw, and a thin shield under the pick holder to keep each pick from rubbing on the body finish.

BRIEF DESCRIPTION OF THE DRAWINGS

FIG. 3A shows a more aesthetic embodiment of the 2-finger pick holder, with two picks (21), two tension screws (25), one mounting screw (27), one finger plate with two fingers (31) and a body finish shield under the picks (29), held in place by all the screws. The outline of the shield follows the bottom contour of the finger plate to protect the guitar finish from everything but the screws. FIG. 3B shows a similar aesthetically-designed pick holder, integral to the pick guard (33) similar to the prototype shown in FIG. 1B. The dotted line shows the extent of the shield under the pick guard, so that it engages the mounting screw (27).

DESCRIPTION OF THE INVENTION

This invention is comprised of one or more finger-like extensions of plate-like semi-flexible material, affixed to a stringed instrument by one or more mounting screws at the base, with the friction and tension to hold different types and thicknesses of picks or plectrums set by one or more tension screws per finger (generally only one), with an optional shield of thin but tough material adjacent to the instrument body below the pick and finger, meant to protect the finish of the instrument from wear by sliding picks under the finger(s). The finger and shield is held in place and position by both the mounting and tension screws. The shield extends entirely underneath the finger structure, so as to protect the instrument finish from any shifting of the finger structure under the tension and mounting screws.

Figure 1B:
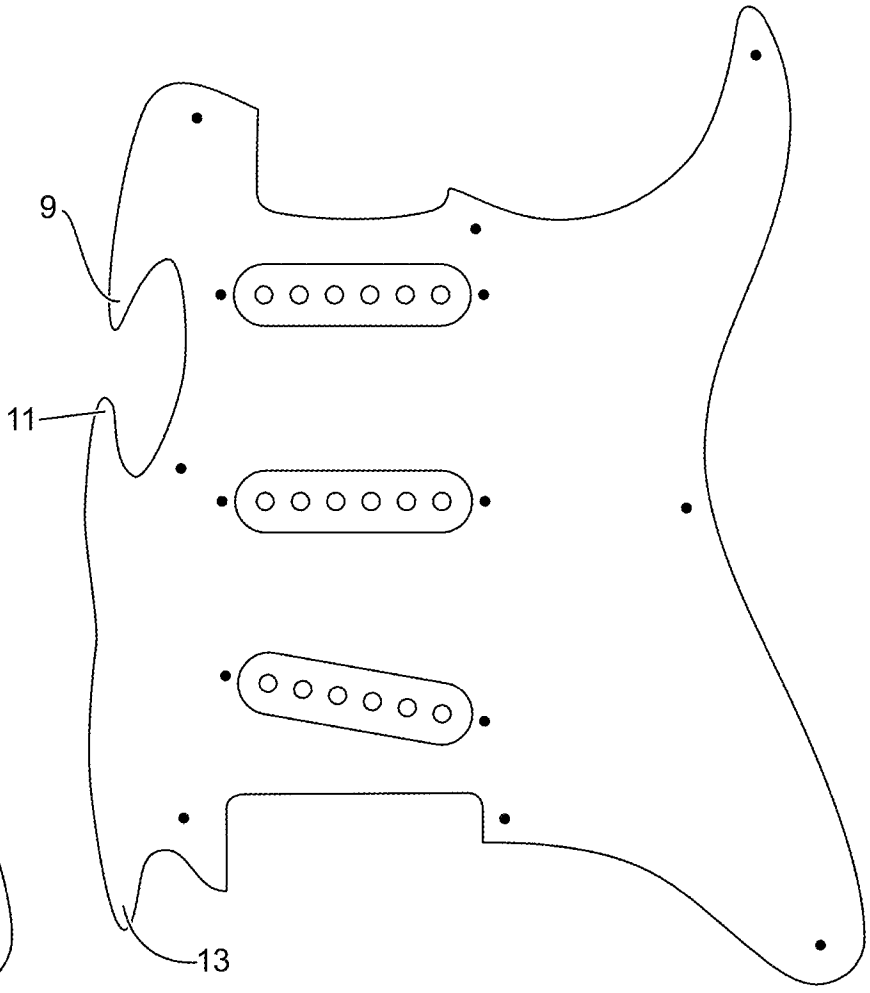
FIG. 1B shows a modified pick guard with integral fingers (7, 11 & 13) meant to hold guitar picks between the pick guard and the body by pressure and friction.
Figure 1A:
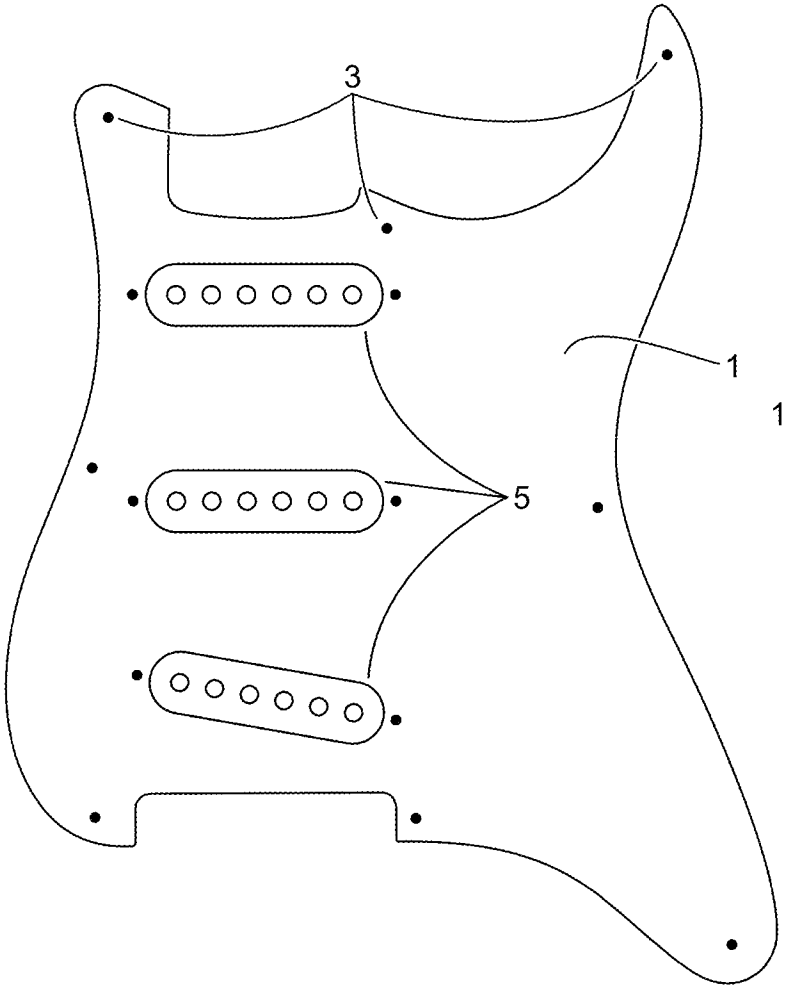
FIG. 1A shows a standard pick guard (1) for a generic S-type electric guitar with pick guard mounting screw holes (3) and three single-coil pickups (5).
Figures 2A, 2B, 2C:
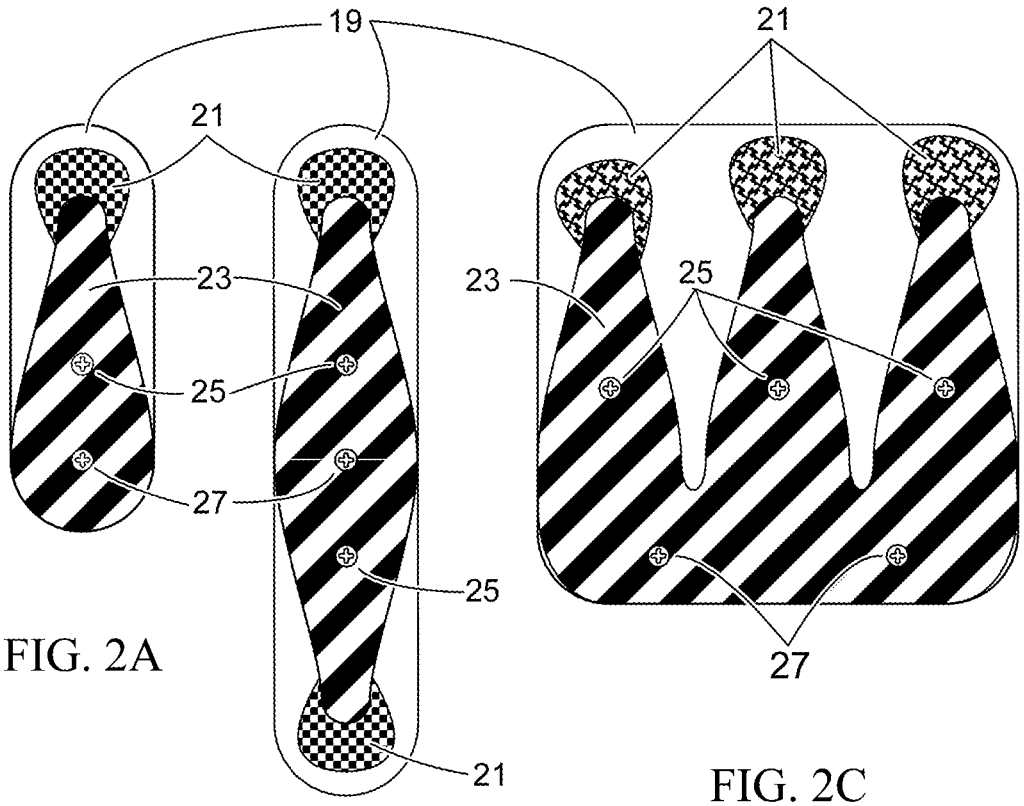
FIG. 2A shows a simple one-finger pick holder of this invention, with an optional shield (19) against the guitar body, and under the pick (21), to protect the body finish from the pick. The pick is held down by friction and pressure, with a flat finger of semi-flexible plate-like material (23), screwed to the body by a screw (27), with a tension screw (25) to adjust for different pick thicknesses.
FIG. 2B shows a 2-finger embodiment with one mounting screw (27) and two tension screws (25).
FIG. 2C shows a 3-finger embodiment with three tension screws (25) and two mounting screws (27). The tension and mounting screws also hold the shield in place.

FIG. 1A shows a standard S-type electric guitar pick guard for comparison. FIG. 1B shows a prototype without tension screws. The fingers can be arranged in any convenient geometric disposition, as shown in FIGS. 2A-B. They can be designed more aesthetically as shown in FIG. 3A, or incorporated into the design of an electric guitar pick guard, as shown in FIGS. 1B and 3B. They can be decorated in various ways (not shown), for example, as upswept eagle or dragon wings, or opposing heads of serpents or other animals. FIGS. 3A&B show a decorative design on the shield. The pick holder & fingers can be front-printed or carved or otherwise decorated, and the body shield can be transparent and back-printed, or otherwise colored or cut to decorative shape.

The invention claimed is:

1. A flat, plate-like device for holding picks to stringed musical instruments, often guitars or basses, comprised of:

a. a flat, plate-like, semi-flexible body with one or more tapering fingers for holding picks to an instrument body, and b. a flat, thin shield material under said device body, fingers and picks, but on top of said instrument body, and c. one or more mounting screws, passing through said body and said shield, to mount said body and shield to said instrument, and d. one or more tension screws per each of said fingers, situated between said finger and said mounting screws, passing through said body and said shield, functioning to adjust the individual pressure of each said finger on said picks, so as to adjust for said pick thickness and surface roughness.

2. An embodiment of the invention as recited in claim 1, wherein said body, said fingers and said shield are cut, carved, printed or otherwise decorated to some pleasing design.

3. An embodiment of the invention as recited in claim 1, wherein said invention is incorporated in to the edged of a pick guard, using an extension of said pick guard as said body and fingers.

4. An embodiment of the invention as recited in claim 1, wherein said invention is a separate device, mounted to said instrument in some place convenient to the user of said instrument.

* * * * *